US009574580B2

(12) United States Patent
Kurosawa et al.

(10) Patent No.: US 9,574,580 B2
(45) Date of Patent: Feb. 21, 2017

(54) OSCILLATING ACTUATOR

(71) Applicant: SMC CORPORATION, Chiyoda-ku (JP)

(72) Inventors: Naoki Kurosawa, Noda (JP); Shintaro Ishikawa, Adachi-ku (JP)

(73) Assignee: SMC CORPORATION, Chiyoda-ku (JP)

( * ) Notice: Subject to any disclaimer, the term of this patent is extended or adjusted under 35 U.S.C. 154(b) by 350 days.

(21) Appl. No.: 14/154,665

(22) Filed: Jan. 14, 2014

(65) Prior Publication Data

US 2014/0208936 A1 Jul. 31, 2014

(30) Foreign Application Priority Data

Jan. 30, 2013 (JP) ..... 2013-016078

(51) Int. Cl.

| | |
|---|---|
| ***F01C 7/00*** | (2006.01) |
| ***F15B 13/00*** | (2006.01) |
| ***F15B 15/02*** | (2006.01) |
| ***F15B 15/12*** | (2006.01) |

(52) U.S. Cl.

CPC ..... *F15B 13/00* (2013.01); *F15B 15/02* (2013.01); *F15B 15/12* (2013.01)

(58) Field of Classification Search

CPC ..... F15B 15/02; F15B 15/12

USPC ..... 92/67

See application file for complete search history.

(56) References Cited

U.S. PATENT DOCUMENTS 3,049,102 A * 8/1962 Reimer ..... F15B 15/12 92/121
3,696,713 A * 10/1972 Ragard ..... F15B 15/12 91/357
4,174,655 A 11/1979 Valente et al.
4,492,150 A * 1/1985 Yates ..... F15B 15/12 417/481

(Continued)

FOREIGN PATENT DOCUMENTS

CN 101862778 A 10/2010
CN 102226850 A 10/2011

(Continued)

OTHER PUBLICATIONS

Office Action issued Jan. 2, 2015 in Korean Patent Application No. 10-2014-0008820 (with English translation).

(Continued)

*Primary Examiner* — Thomas E Lazo
*Assistant Examiner* — Daniel Collins
(74) *Attorney, Agent, or Firm* — Oblon, McClelland, Maier & Neustadt, L.L.P.

(57) ABSTRACT

To provide an oscillating actuator which is capable of easily changing an oscillation start position of a shaft. An oscillating actuator includes an actuator main body 2 having a shaft 4 which is configured to oscillate about an axis L in a predetermined range of angle by means of a compressed air, and a fixing plate 3 for fixing the actuator main body 2 to a load device 30, wherein the actuator main body 2 and the fixing plate 3 are connected together by a connection mechanism 5 so as to be displaceable relative to each other in the rotation direction of the shaft 4 so that an oscillation start position A of the shaft 4 is changed by displacement of the actuator main body 2 and the fixing plate 3 relative to each other.

9 Claims, 4 Drawing Sheets

(56) References Cited

U.S. PATENT DOCUMENTS

| | | | | |
|---|---|---|---|---|
| 6,474,214 | B2 | 11/2002 | Takeuchi et al. | |
| 2009/0205486 | A1 * | 8/2009 | Ante ..... | F15B 15/24 92/31 |
| 2010/0064834 | A1 | 3/2010 | Takeuchi et al. | |
| 2013/0194688 | A1 | 8/2013 | Zhu et al. | |

FOREIGN PATENT DOCUMENTS

| | | | |
|---|---|---|---|
| CN | 202040047 | U | 11/2011 |
| DE | 10 2010 050 612 | A1 | 5/2012 |
| JP | 60-192286 | U | 12/1985 |
| JP | 3-44209 | | 4/1991 |
| JP | 5-58905 | | 8/1993 |
| KR | 1995-0006405 | B1 | 6/1995 |
| KR | 10-2010-0032822 | | 3/2010 |
| TW | 475036 | | 2/2002 |
| TW | M338284 | | 8/2008 |

OTHER PUBLICATIONS

Combined Office Action and Search Report issued Oct. 29, 2015 in Chinese Patent Application No. 201410038134.2 (with English translation).

Combined Taiwanese Office Action and Search Report dated Oct. 8, 2015 in Taiwanese Application No. 103101964 w/English translation.

* cited by examiner

OSCILLATING ACTUATOR

TECHNICAL FIELD

The present invention relates to an oscillating actuator in which a shaft is configured to oscillate about its axis in a predetermined range of angle by means of a compressed air.

BACKGROUND ART

A vane type oscillating actuator, for example, as disclosed in Patent Document 1 is commonly known as the above type of oscillating actuator. In this vane type oscillating actuator, a vane mounted on a shaft and a fixed wall which defines an oscillation angle of the vane are disposed inside a body which is formed in a cylindrical shape. The vane is oscillated by alternatively supplying and exhausting a compressed air to and from pressure chambers located on each side of the vane through ports, and an oscillation motion of the vane is output via the shaft so that the shaft oscillates a load such as a robot hand, a transportation table or the like by a predetermined angle.

The oscillating actuator is connected to a device having the load (load device) in a certain orientation by using screws or the like and is used in a state that the shaft is connected to the load. In some cases, however, the oscillation start position of the shaft when the oscillating actuator is connected to the load device may not match the oscillation start position of the load depending on the load device, or the oscillation start position of the load may need to be changed when performing a different operation process. In such cases, it is preferable that the oscillation start position of the shaft of the oscillating actuator can be adjusted for the oscillation start position of the load.

This can be achieved, for example, by changing the mounting orientation of the oscillating actuator to the load device in the rotation direction of the shaft. However, a technique to easily achieve the changing has not been proposed. Moreover, it is not preferable that the load device itself is provided with a configuration which allows the mounting orientation of the oscillating actuator to be changed, since it leads to a complicated structure or increased cost. Accordingly, there is a need for an oscillating actuator which is capable of changing the oscillation start position of the shaft.

CITATION LIST

Patent Literature

[PTL 1] Japanese Unexamined Utility Model Registration Application Publication No. 60-192286

SUMMARY OF THE INVENTION

Technical Problem

The present invention provides an oscillating actuator having a reasonable design structure which is capable of easily changing the oscillation start position of the shaft.

Solution to Problem

According to the present invention, an oscillating actuator includes an actuator main body having a shaft which is configured to oscillate about an axis in a predetermined range of angle by means of a compressed air; and a fixing plate for fixing the actuator main body to a load device, wherein the actuator main body and the fixing plate are connected together by a connection mechanism so as to be displaceable relative to each other in the rotation direction of the shaft so that an oscillation start position of the shaft is changed by displacement of the actuator main body and the fixing plate relative to each other.

In the present invention, the fixing plate is connected to a plate mounting surface from which the shaft of the actuator main body extends, a shaft lead-out hole is formed on the fixing plate such that the shaft is led out to an outside of the fixing plate through the shaft lead-out hole, the connection mechanism includes a plurality of screw holes that are disposed on the plate mounting surface of the actuator main body in the circumferential direction about the axis at specific intervals, a plurality of screw insertion holes that are disposed on the fixing plate in the circumferential direction about the axis at specific intervals, and a plurality of connection screws that are inserted into the screw insertion holes and are threaded into the screw holes, the number of screw holes is an integer multiple of the number of the screw insertion holes, and the number of connection screws is equal to the number of screw insertion holes.

According to an embodiment of the present invention, one set of the screw insertion holes, each set composed of two screw insertion holes, are disposed on the fixing plate, and a plurality of sets of the screw holes, each set composed of two screw holes which are arranged in the same manner as the two screw insertion holes, are disposed on the actuator main body at different positions about the axis.

In this case, it is preferable that the one set of screw insertion holes are disposed at symmetrical positions with respect to the axis, and the one set of screw holes are disposed at symmetrical positions with respect to the axis.

Further, according to another embodiment of the present invention, one set of the screw insertion holes, each set composed of three screw insertion holes, are formed on the fixing plate, and one or more sets of the screw holes, each set composed of three screw holes which are arranged in the same manner as the one set of the screw insertion holes, are disposed on the actuator main body.

In this case, it is preferable that the one set of the screw insertion holes are disposed about the axis at intervals of 120 degrees and the one set of the screw holes are disposed about the axis at intervals of 120 degrees.

Further, in the present invention, it is preferable that the fixing plate has a plurality of fixing holes through which a fixing screw is inserted for connecting the fixing plate to the load device, the fixing holes include vertical fixing holes that penetrate the fixing plate in a direction parallel to the axis and horizontal fixing holes that penetrate the fixing plate in a direction perpendicular to the axis.

In this case, the two horizontal fixing holes are formed in parallel to each other at opposite positions with respect to the shaft and the two screw insertion holes.

Advantageous Effects of Invention

According to the present invention, the oscillation start position of the shaft can be easily changed by changing the connection position of the actuator main body to the fixing plate in the rotation direction of the shaft.

DESCRIPTION OF EMBODIMENTS

Figure 1:
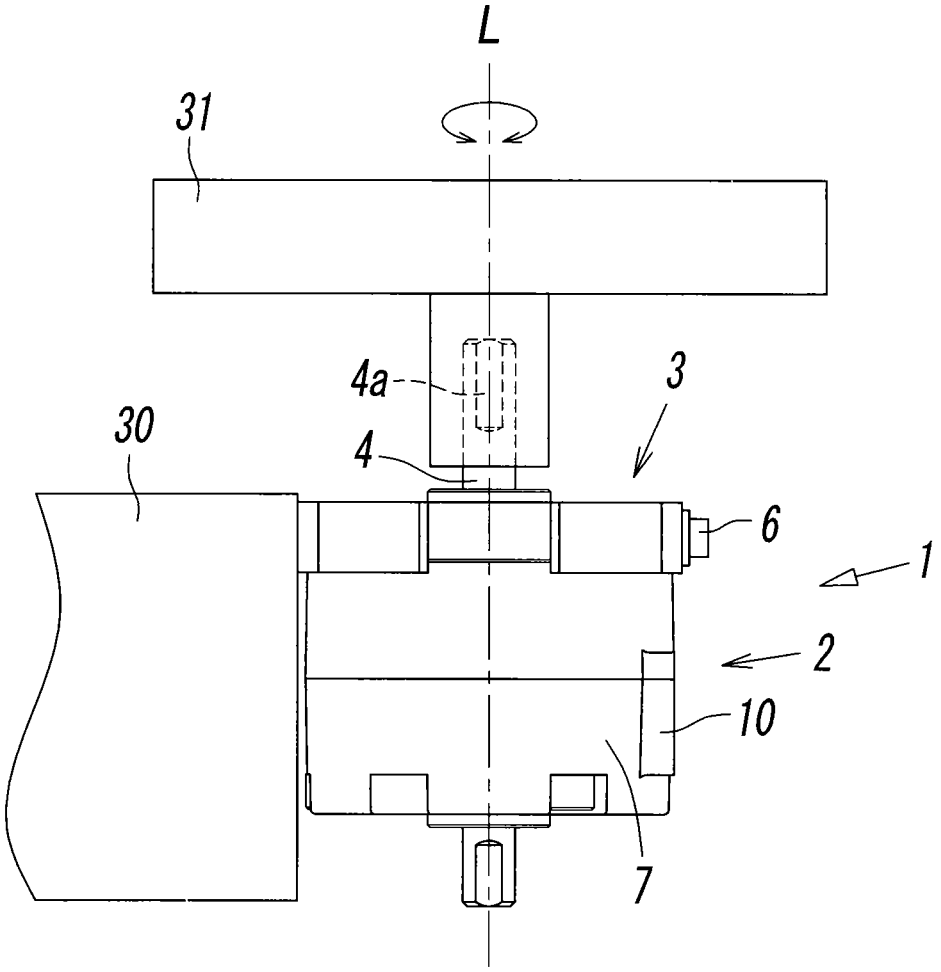
FIG. 1 is a side view which shows a use mode of an oscillating actuator according to the present invention.
Figure 2:
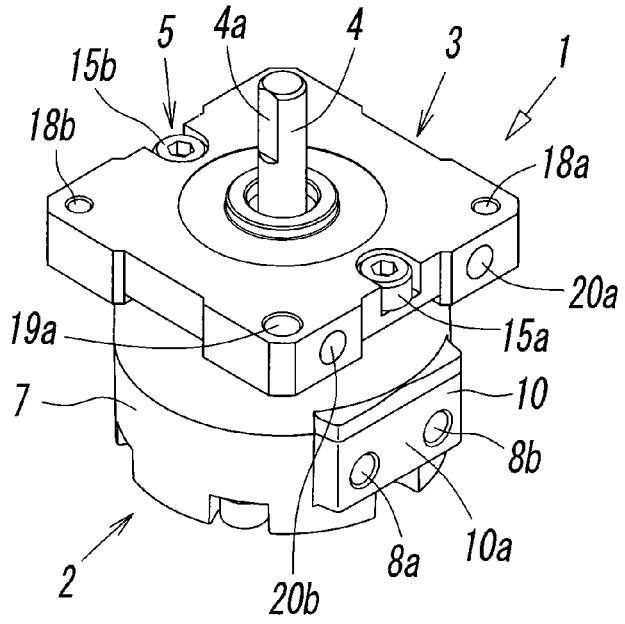
FIG. 2 is a perspective view of the oscillating actuator of FIG. 1.
Figure 3:
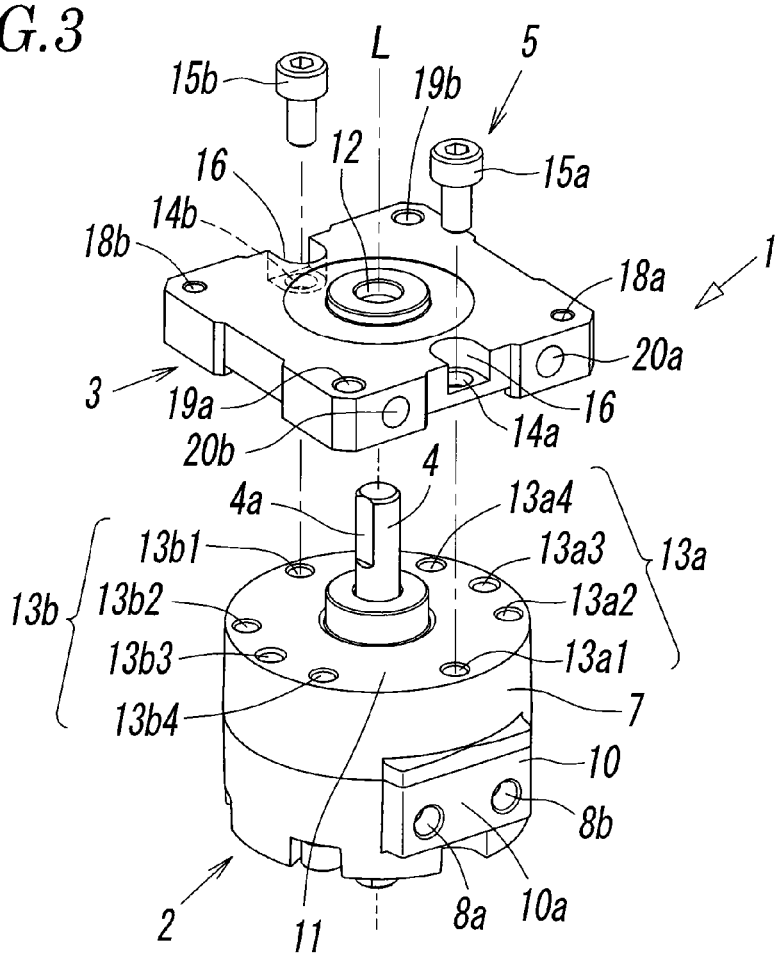
FIG. 3 is a perspective view which shows an actuator main body and a fixing plate in a separated state.

FIG. 1 is a side view which shows an example of a use mode of an oscillating actuator according to the present invention. As seen from FIGS. 2 and 3, the oscillating actuator 1 includes an actuator main body 2 having a shaft 4 which is configured to oscillate about an axis L of the shaft 4 in a predetermined range of angle by means of a compressed air and a fixing plate 3 for fixing the actuator main body 2 to a load device 30, and the actuator main body 2 and the fixing plate 3 are connected together by a connection mechanism 5. The fixing plate 3 is connected to a load device 30 via a fixing screw 6 and the shaft 4 is connected to a load 31 such as a robot hand, a transportation table or the like such that the shaft 4 oscillates the load 31 by a predetermined angle.

The actuator main body 2 has a configuration as a vane type oscillating actuator. A vane (not shown in the figure) mounted on the shaft 4 and a fixed wall (not shown in the figure) which defines an oscillation angle of the vane are disposed inside a body 7 which is formed in a cylindrical shape. The vane is oscillated by alternatively supplying and exhausting a compressed air to and from pressure chambers located on each side of the vane through ports 8*a*, 8*b*, and an oscillation motion of the vane is output via the shaft 4.

Figure 4:
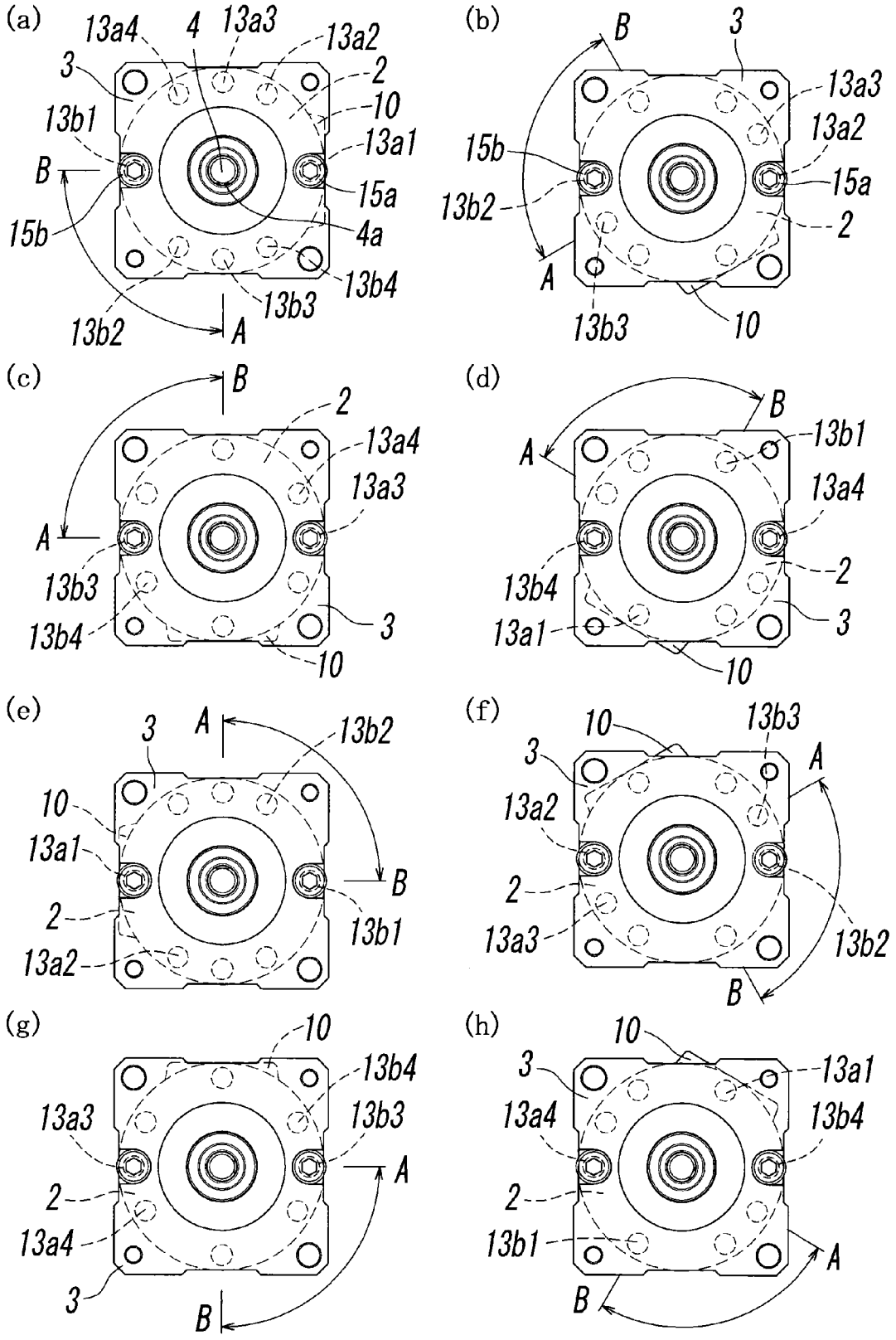
FIGS. 4(*a*) to 4(*h*) are plan views which show different oscillation start positions of a shaft of the oscillating actuator which is shown in FIGS. 1 to 3.

As shown in FIG. 4, the shaft 4 of the illustrated actuator main body 2 is configured to oscillate in the range of angle of 90 degrees with one end of the range of angle being defined as an oscillation start position A, while the other end of the range of angle being defined as an oscillation end position B. A flat surface 4*a* is formed on the side face of the shaft 4 and the flat surface 4*a* faces the oscillation start position A in an initial state prior to start of the oscillation motion of the shaft 4. Accordingly, an orientation of the oscillation start position A can be indicated by the flat surface 4*a*. It should be noted that the range of the oscillation angle of the shaft 4 may be 90 degrees or more or 90 degrees or less.

The internal configuration of the vane type oscillating actuator is well known, and the actuator main body 2 according to the present embodiment also has the well-known internal configuration. In addition, the internal configuration per se is not directly related to the subject matter of the present invention. Accordingly, the specific description of the internal configuration of the actuator main body 2 will be omitted.

A port forming section 10 having a flat connection port surface 10*a* is disposed on the side face of the body 7 of the actuator main body 2, and the ports 8*a*, 8*b* are open to the connection port surface 10*a* of the port forming section 10. Further, one end face of the body 7 in the axis direction L is a plate mounting surface 11 in a circular shape on which the fixing plate 3 is mounted, and the shaft 4 extends outward from the center of the plate mounting surface 11.

The fixing plate 3 is a member having a square shape in plan view, each side of which has a length equal to or larger than a diameter of the actuator main body 2. A shaft lead-out hole 12 is formed at the center of the fixing plate 3 such that the shaft 4 is led out to the outside through the shaft lead-out hole 12.

The connection mechanism 5 which connect the actuator main body 2 and the fixing plate 3 includes a plurality of pairs of screw holes 13*a*, 13*b* formed on the plate mounting surface 11 of the actuator main body 2, a pair of, that is, two screw insertion holes 14*a*, 14*b* formed on the fixing plate 3, and two connection screws 15*a*, 15*b* which are inserted into the screw insertion holes 14*a*, 14*b* and are selectively threadable into any one pair of screw holes of the plurality of pairs of screw holes 13*a*, 13*b*.

The plurality of pairs of screw holes 13*a*, 13*b* formed on the plate mounting surface 11 are composed of pairs of screw holes, each pair composed of two screw holes disposed at symmetrical positions with respect to the axis L of the shaft 4. In the figure, four pairs of screw holes 13*a*1, 13*b*1/13*a*2, 13*b*2/13*a*3, 13*b*3/13*a*4, 13*b*4 are arranged at different positions in the rotation direction of the shaft 4 at specific angular intervals.

The two screw insertion holes 14*a*, 14*b* formed on the fixing plate 3 are arranged at symmetrical positions with respect to the axis L of the shaft 4 at the center of each of a pair of opposing sides of the fixing plate 3. Counterbores 16 are formed at positions of the screw insertion holes 14*a*, 14*b* so that the entire head of the connection screws 15*a*, 15*b* are fit in the depth of the counterbores 16.

When the connection screws 15*a*, 15*b* are inserted into the screw insertion holes 14*a*, 14*b* and distal ends of the connection screws 15*a*, 15*b* are threaded into one of the pairs of screw holes 13*a*1, 13*b*1/13*a*2, 13*b*2/13*a*3, 13*b*3/13*a*4, 13*b*4 of the plurality of pairs of screw holes 13*a*, 13*b*, the fixing plate 3 is connected to the plate mounting surface 11 of the actuator main body 2.

Further, a plurality of fixing holes into which the screws are inserted so as to connect the fixing plate 3 to the load device 30 are formed on the fixing plate 3. The fixing holes includes four vertical fixing holes 18*a*, 18*b*/19*a*, 19*b* that penetrate the fixing plate 3 in a direction parallel to the axis L and two horizontal fixing holes 20*a*, 20*b* that penetrate the fixing plate 3 in a direction perpendicular to the axis L. The vertical fixing holes 18*a*, 18*b*/19*a*, 19*b* are formed at the corners of the fixing plate 3 and are open to the upper and lower surfaces of the fixing plate 3, while the horizontal fixing holes 20*a*, 20*b* are formed at opposite positions with respect to the shaft 4 and the two screw insertion holes 14*a*, 14*b* and are open to the right and left side faces of the fixing plate 3. In the example shown in the figure, the fixing plate 3 is fixed to the load device 30 by the fixing screws 6 which are inserted into the horizontal fixing holes 20*a*, 20*b*.

It should be noted that the fixing plate 3 may be fixed to the load device 30 using the vertical fixing holes 18*a*, 18*b*/19*a*, 19*b* depending on the structure or form of the load device 30. In such cases, of the two pairs of vertical fixing holes 18*a*, 18*b*/19*a*, 19*b*, each pair located in the diagonal direction of the fixing plate 3, either the pair of vertical fixing holes 18*a*, 18*b* or the pair of 19*a*, 19*b* is used. However, the two pairs of vertical fixing holes 18*a*, 18*b*/19*a*, 19*b* may also be used.

In the example shown in the figure, of the four vertical fixing holes 18*a*, 18*b*/19*a*, 19*b*, the vertical fixing holes 18*a*, 18*b* located at positions in one diagonal directions have an equal size and the vertical fixing holes 19*a*, 19*b* located at positions in the other diagonal directions have an equal size, and the vertical fixing holes 18*a*, 18*b* have a size different from that of the vertical fixing holes 19*a*, 19*b*. However, all the four vertical fixing holes 18*a*, 18*b*/19*a*, 19*b* may have an equal size.

In the oscillating actuator 1 having the above configuration, when it is necessary to change the oscillation start position A of the load 31, that is, the shaft 4, the oscillation start position A can be changed by relatively changing the connection position of the actuator main body 2 and the fixing plate 3 in the rotation direction of the shaft 4. This changing operation is performed by removing the two connection screws 15*a*, 15*b* from the screw holes 13*a*, 13*b*, rotating the actuator main body 2 with respect to the fixing plate 3 about the axis L by a necessary angle in a necessary direction, and threading the connection screws 15*a*, 15*b* into the other pair of the screw holes 13*a*, 13*b*. As a result, the oscillation start position A is changed to a position which corresponds to the selected screw holes 13*a*, 13*b*.

The changing operation may be performed in a state that the oscillating actuator 1 is mounted on the load device 30 or after the oscillating actuator 1 is removed from the load device 30, or alternatively, before the oscillating actuator 1 is initially mounted on the load device 30.

In the example shown in the figure, four pairs of screw holes 13*a*1, 13*b*1/13*a*2, 13*b*2/13*a*3, 13*b*3/13*a*4, 13*b*4 are provided. Accordingly, as shown in FIGS. 4(*a*) to 4(*h*), there are eight combinations for two connection screws 15*a*, 15*b* being threaded into the four pairs of screw holes 13*a*1, 13*b*1/13*a*2, 13*b*2/13*a*3, 13*b*3/13*a*4, 13*b*4, and accordingly, eight different oscillation start positions A are possible.

It should be noted that the screw holes 13*a*, 13*b* may be composed of three or less pairs of screw holes or five or more pairs of screw holes. In other words, the screw holes 13*a*, 13*b* of an integer multiple of the number of the screw insertion holes 14*a*, 14*b* and the connection screws 15*a*, 15*b* are possible. In this case, the number of possible different oscillation start positions A varies depending on the number of pairs of screw holes 13*a*, 13*b*. Further, when a plurality of pairs of screw holes 13*a*, 13*b* are provided, the plurality of pairs of screw holes may be disposed in the circumferential direction about the axis L at equal intervals or different intervals.

The pair of (set of) screw holes 13*a*, 13*b* and the pair of (set of) screw insertion holes 14*a*, 14*b* are not necessarily located at symmetrical positions with respect to the axis L as in the example shown in the figure, and may be located at asymmetrical positions with respect to the axis L.

Figure 5A:
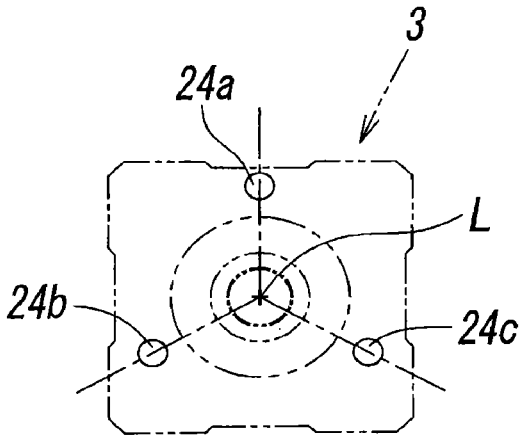
FIGS. 5A-5B are plan view of the actuator main body showing an embodiment where the plurality of screw holes are spaced by 120°.
Figure 5B:
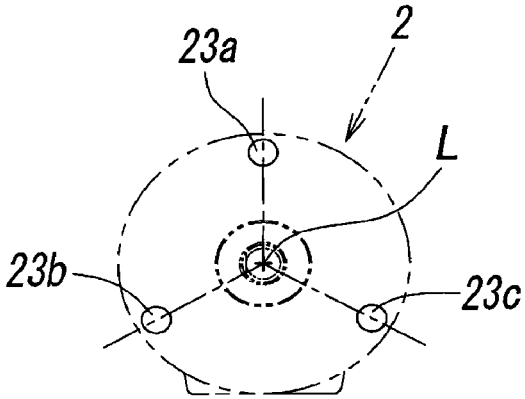

Alternatively, three or more screw holes and three or more screw insertion holes are taken as a set of screw holes and a set of screw insertion holes, respectively, and only one set of the screw insertion holes may be provided on the fixing plate 3 and one or more sets of screw holes may be provided on the actuator main body 2. For example, three screw insertion holes 24A, 24B, 24C (FIG. 5A)may be disposed on the fixing plate 3 in the circumferential direction about the axis L at equal intervals, that is, at intervals of 120 degrees, and three screw holes may be disposed on the actuator main body 2 in the circumferential direction about the axis L at equal intervals, that is, at intervals of 120 degrees (FIG. 5B). Alternatively, a plurality of sets of screw holes, each set composed of three screw holes which are arranged at equal intervals, may be disposed at different positions in the circumferential direction about the axis L. In this case, the number of connection screws is three. The interval between each of the three screw insertion holes and the interval between each of the three screw holes are not necessarily equal.

Although the body 7 of the actuator main body 2 in the example shown in the figure is formed in a cylindrical shape, the body 7 may be formed in a quadratic prism or other prismatic shape.

Further, the shape of the fixing plate in plan view may be a rectangular shape or a polygonal shape other than a rectangle (for example, triangle, pentagon, hexagon or the like), or alternatively, may be a circular shape.

Moreover, although the actuator main body 2 is formed as a vane type oscillating actuator, the actuator main body 2 may be a rack and pinion type oscillating actuator. This rack and pinion type oscillating actuator includes a piston and a rack and pinion mechanism which are housed in the body. A linear thrust obtained by the piston is converted into a rotational torque by the rack and pinion mechanism and is output via the shaft which extends from the body. Such a configuration of the rack and pinion type oscillating actuator per se is well-known.

REFERENCE SIGNS LIST

1 oscillating actuator
2 actuator main body
3 fixing plate
4 shaft
5 connection mechanism
6 fixing screw
11 plate mounting surface
13*a*, 13*b* screw hole
14*a*, 14*b* screw insertion hole
15*a*, 15*b* connection screw
18*a*, 18*b*, 19*a*, 19*b* vertical fixing hole
20*a*, 20*b* horizontal fixing hole
L axis
A oscillation start position

The invention claimed is:

1. An oscillating actuator comprising:

an actuator main body having a shaft which is configured to oscillate and rotate about an axis in a predetermined range of angle by an action of a compressed air; and a fixing plate for fixing the actuator main body to a load device, wherein the fixing plate is not part of the actuator main body and is an independent element separate from the actuator main body, wherein the actuator main body and the fixing plate are connected together by a connection mechanism so as to relatively change each other's position in the rotation direction of the shaft so that an oscillation start position of the shaft is changed by displacement of the actuator main body and the fixing plate relative to each other, and wherein the connection mechanism includes a plurality of screw holes that are disposed on a plate mounting surface of the actuator main body in the circumferential direction about the axis at specific intervals, a plurality of screw insertion holes that are disposed on the fixing plate in the circumferential direction about the axis at specific intervals, and a plurality of connection screws that are inserted into the screw insertion holes and are threaded into the screw holes, and wherein the number of screw holes is an integer multiple of the number of the screw insertion holes, and the number of connection screws is equal to the number of screw insertion holes.

2. The oscillating actuator according to claim 1, wherein the fixing plate is connected to the plate mounting surface from which the shaft of the actuator main body extends, a shaft lead-out hole is formed on the fixing plate such that the shaft is led out to an outside of the fixing plate through the shaft lead-out hole, and wherein the screw holes are formed on the plate mounting surface.

3. The oscillating actuator according to claim 1, wherein one set of the screw insertion holes, each set composed of two screw insertion holes, are disposed on the fixing plate, and a plurality of sets of the screw holes, each set composed of two screw holes which are arranged in the same manner as the two screw insertion holes, are disposed on the actuator main body at different positions about the axis.

4. The oscillating actuator according to claim 3, wherein the one set of screw insertion holes are disposed at symmetrical positions with respect to the axis, and the one set of screw holes are disposed at symmetrical positions with respect to the axis.

5. The oscillating actuator according to claim 1, wherein one set of the screw insertion holes, each set composed of three screw insertion holes, are formed on the fixing plate, and one or more sets of the screw holes, each set composed of three screw holes which are arranged in the same manner as the one set of the screw insertion holes, are disposed on the actuator main body.

6. The oscillating actuator according to claim 5, wherein the one set of the screw insertion holes are disposed about the axis at intervals of 120 degrees and the one set of the screw holes are disposed about the axis at intervals of 120 degrees.

7. The oscillating actuator according to claim 1, wherein the fixing plate has a plurality of fixing holes through which a fixing screw is inserted for connecting the fixing plate to the load device, the fixing holes include vertical fixing holes that penetrate the fixing plate in a direction parallel to the axis and horizontal fixing holes that penetrate the fixing plate in a direction perpendicular to the axis.

8. The oscillating actuator according to claim 3, wherein the fixing plate has a plurality of fixing holes through which a fixing screw is inserted for connecting the fixing plate to the load device, the fixing holes include vertical fixing holes that penetrate the fixing plate in a direction parallel to the axis and horizontal fixing holes that penetrate the fixing plate in a direction perpendicular to the axis.

9. The oscillating actuator according to claim 8, wherein the two horizontal fixing holes are formed in parallel to each other at opposite positions with respect to the shaft and the two screw insertion holes.

* * * * *